United States Patent [19]

Eisenhauer

[11] 4,347,635

[45] Sep. 7, 1982

[54] STRETCHER AND LITTER COMBINATION

[75] Inventor: Leigh E. Eisenhauer, Van Wert, Ohio

[73] Assignee: The Eisenhauer Manufacturing Company, Van Wert, Ohio

[21] Appl. No.: 116,831

[22] Filed: Jan. 30, 1980

[51] Int. Cl.[3] ..... B63C 9/04

[52] U.S. Cl. ..... 441/40; 5/82 R; 280/18; 296/19; 441/88

[58] Field of Search ..... 9/11 R, 13, 14; 244/137 P; 114/0.5 F, 66.5 F; 5/82 R; 280/18, 19, 24; 296/19, 20

[56] References Cited

U.S. PATENT DOCUMENTS

| | | | |
|---|---|---|---|
| 2,394,264 | 2/1946 | Robinson | 5/82 |
| 3,133,295 | 5/1964 | Klingensmith | 9/11 R |
| 3,222,080 | 12/1965 | Kinraide | 280/18 R |
| 3,348,245 | 10/1967 | Shindler | 5/82 R |
| 3,414,914 | 12/1968 | Gramins | 5/82 R |
| 3,609,778 | 10/1971 | Zeiner | 5/82 R |
| 3,711,879 | 1/1973 | Siefert | 9/11 R |
| 3,789,446 | 2/1974 | Rudelick | 9/11 R |
| 3,887,953 | 6/1975 | Eisenhauer | 9/11 R |
| 3,962,740 | 6/1976 | White | 9/11 R X |
| 3,970,024 | 7/1976 | Fisher | 9/11 R X |
| 4,149,919 | 4/1979 | Lea et al. | 9/13 X |
| 4,183,110 | 1/1980 | Kidd et al. | 5/82 R |

OTHER PUBLICATIONS

The Eisenhauer Marine Litter, RSQ-1, Eisenhauer Manufacturing Co. Inc., 1980.

*Primary Examiner*—Joseph F. Peters, Jr.
*Assistant Examiner*—M. J. Hill
*Attorney, Agent, or Firm*—Whittemore, Hulbert & Belknap

[57] ABSTRACT

A stretcher and litter combination, including a buoyant raft-like structure adapted for use as a rescue or recovery litter, and a buoyant stretcher. The litter has pontoons on either side of an elongated body section. The stretcher is in the form of an elongated board releasably secured to the body section of the litter.

7 Claims, 12 Drawing Figures

FIG. 10
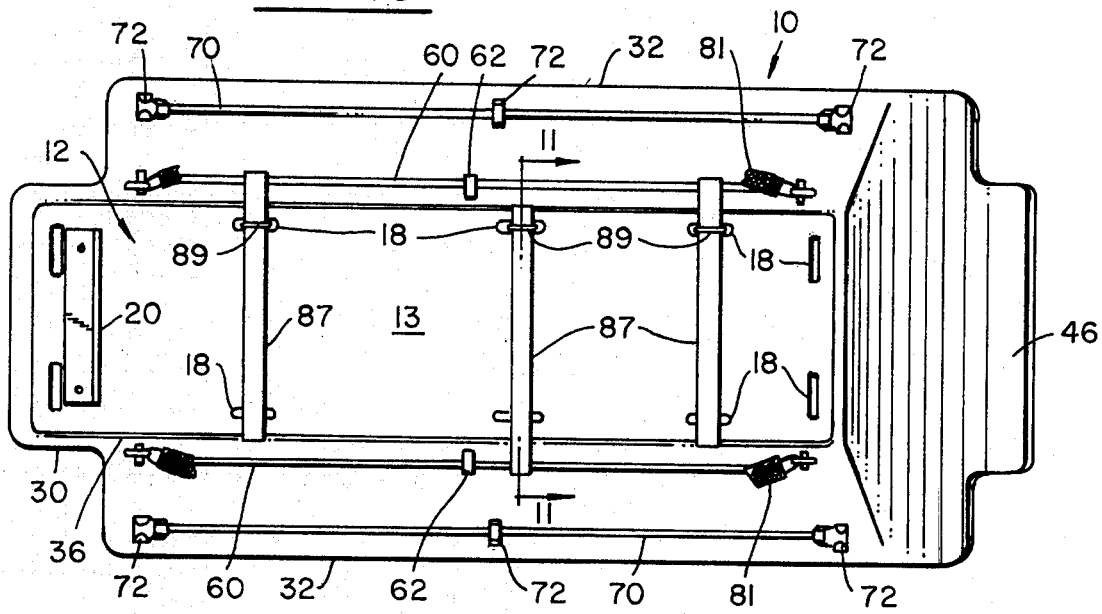
FIG. 11
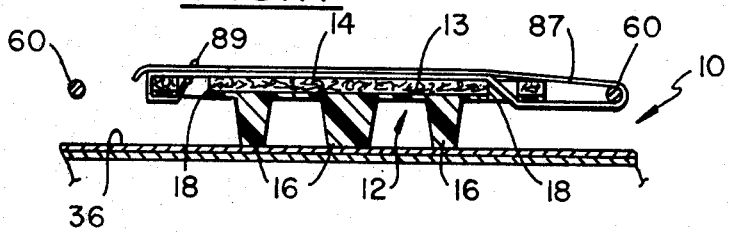
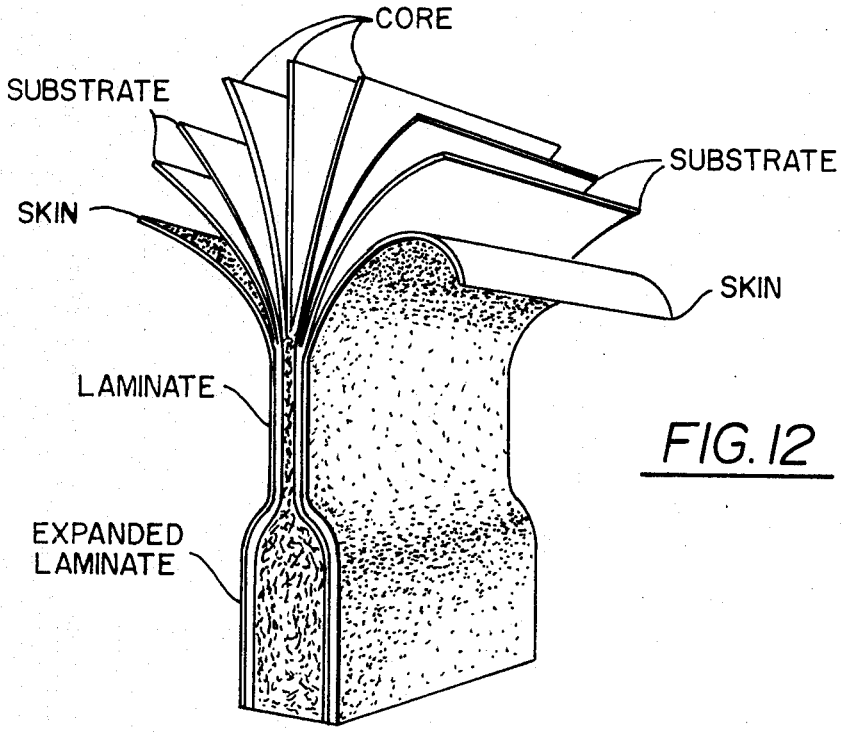
FIG. 12

STRETCHER AND LITTER COMBINATION

This invention relates generally to a stretcher and litter combination, and refers more particularly to a buoyant raft-like structure adapted for use as a rescue or recovery litter, and a stretcher adapted to be supported thereon and releasably secured thereto.

BACKGROUND AND SUMMARY OF THE INVENTION

A raft or litter of somewhat similar construction to the one shown and described herein is disclosed in my prior U.S. Pat. No. 3,887,953. It was originally intended for use primarily in rescue missions for expeditiously transporting an injured person from point of mishap to an ambulance or point of medical facilities. As an example, the raft might be used as a standby unit on duty at power boat races to facilitate the safe and speedy rescue of injured drivers.

It has been found that under some circumstances, in close quarters for example, it is desirable to use a stretcher in combination with the litter, as a removable piggyback unit. In accordance with the present invention, a piggyback stretcher is secured to the deck of the litter. Accordingly, a victim may be lifted from the litter by means of the stretcher, and another stretcher may then be secured to the deck of the litter and the stretcher-litter combination sent back to the point of need.

The stretcher-litter combination is relatively light in weight so that it may be easily manipulated in and out of the water and may be of a size to accommodate one person or more than one person. The deck of the stretcher is disposed close to the level of the water when the litter and stretcher are afloat, so that by slightly depressing the rear end, a victim may be readily floated abroad. The stretcher-litter is highly maneuverable in the water, and is easily manageable on shore so that a victim may be transferred to an ambulance by removing the stretcher and victim from the litter.

Other objects and features of the invention will become more apparent as this description proceeds, especially when taken in conjunction with the accompanying drawings wherein;

BRIEF DESCRIPTION OF THE DRAWINGS

FIG. 10 is a top plan view similar to FIG. 2 but showing a different means for attaching the stretcher to the litter;

FIG. 11 is a sectional view taken on the line 1—1 in FIG. 10.

FIG. 12 is a perspective view of a laminate used in construction of the stretcher and litter.

DETAILED DESCRIPTION

Figure 1:
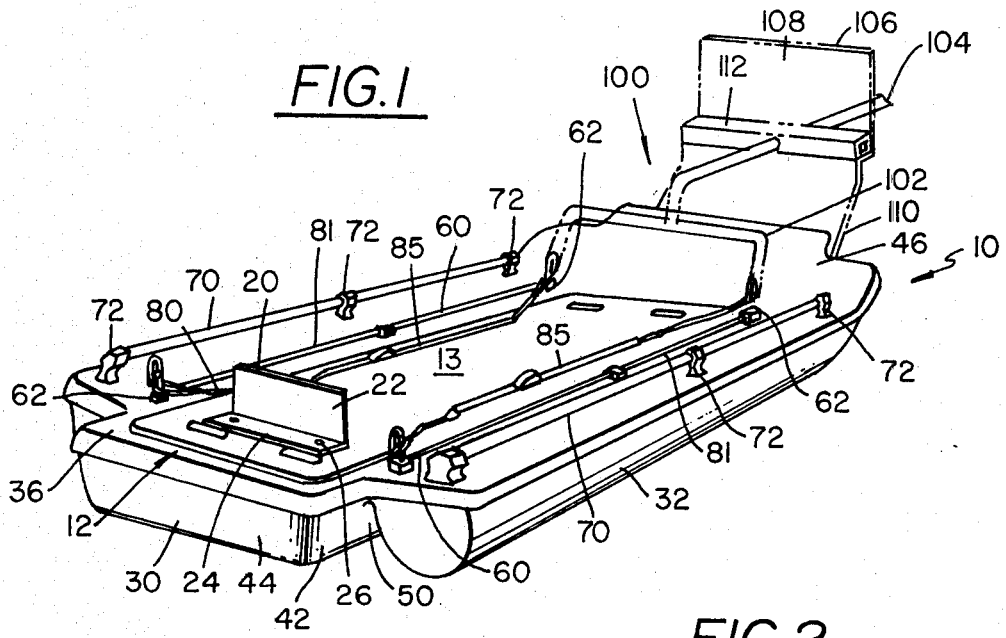
FIG. 1 is a perspective view of a litter and stretcher combination, constructed in accordance with my invention.

Referring now more particularly to the drawings, the stretcher and litter combination comprises a litter 10 and a stretcher 12.

The stretcher 12 is in the form of an elongated body section or board 13 of generally rectangular shape having a flat, planar top surface 14 and having spaced, parallel ribs 16 on the underside extending lengthwise of the board for substantially the full length thereof. Handholes 18 are provided about the periphery of the board 13. A foot rest 20 is rigidly secured to the top surface 14 of the board 13 adjacent one end thereof. The foot rest is of generally L-shape, having a flange 22 projecting up at approximately a right angle to the top surface 14 and a flange 24 attached to the top surface by fasteners 26.

The stretcher 12 is relatively rigid in construction and may be made of any suitable, preferably relatively lightweight material. For best results, the upper portion 23 of the stretcher board may be formed of a modified Acrylonitrile-Butadiene-Styrene (ABS) material sold under the trademark Royalex, a product of Uniroyal Plastic Products Division of Uniroyal, Inc., and the lower portion 25, including the ribs, may be formed of a suitable rigid fiberglass reinforced plastic. The ribs 16 may be hollow to reduce weight and increase flotation.

The modified ABS material (Royalex) of which the upper portion 23 of the stretcher board is formed is a thermoplastic laminate of substrate, core, and substrate. Skins of nylon may complete the sandwich to improve weatherability (See FIG. 12). The core is a rigid lightweight unicellular ABS material that functions as the separator for the tough ABS substrate layers and contributes to the high rigidity by increasing the moment of inertia for the overall laminate. The substrate layers are unfoamed and function as stressed skins and, because of the nature of the ABS terpolymer, afford high impact resistance. This laminate is chemically bonded under high heat and pressure. When the laminate is heated to approximately 300° F. as part of the conventional thermoplastic forming process, a chemical blowing agent causes the core to expand. FIG. 12 shows the laminate unexpanded and also expanded, it being understood that the expanded condition is that in which the product is used in the stretcher board.

Since the stretcher and litter combination is intended to be used for water rescue purposes, both the stretcher and litter should be floatable.

The stretcher 12 is of sufficient length to support the body of a person reclining thereon and is adapted to be mounted on and releasably secured to the litter 10 which will now be described.

The litter 10 comprises a body section 30 and pontoons 32. The body section 30 is an elongated generally rectangular box-like structure having flat, horizontal top and bottom walls 36 and 38 and side and end walls 40, 42 and 44. At the front, the body section has a forwardly and upwardly inclined portion 46 turned at an angle of approximately 25° to the plane of the box-like structure. The length and width of the top 36 of the litter are slightly greater than the length and width of the stretcher 10. The body section 30, including the upwardly inclined front portion 46 thereof is formed of a strong, rigid, lightweight material such as a suitable plastic, for example, foamed or expanded polyurethane. Desirably the polyurethane is covered on its outer surfaces with the laminate shown in FIG. 12 which previously has been described as a modified ABS material (Royalex). The laminate provides a tough shock and water resistant surface.

The pontoons 32 may be formed of the same material as the body section, namely expanded polyurethane covered with the modified ABS laminate. The pontoons extend lengthwise of the litter along opposite sides of the body section. The laminates covering the pontoons on the top and bottom are in the present instance lateral extensions of the top and bottom laminates covering the body section 30. The pontoons are generally cylindrical throughout most of their length except for the top surface portions thereof which as seen are substantially flat and slope downwardly and inwardly from a level above the top surface of the body section at their outer longitudinal edges to about the level of the top surface of the body section at their inner longitudinal edges.

The undersides of the front ends of the pontoons are inclined in an upward and forward direction at the same angle as the underside of the upwardly inclined front portion 46 of the body section 30 and in a plane substantially coincident therewith. Hence, when pulled through the water, the litter will ride over the water surface rather than plow through it or nose under.

Figure 4:
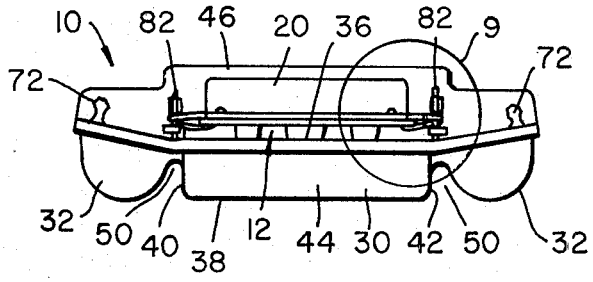
FIG. 4 is an end view.
Figure 5:
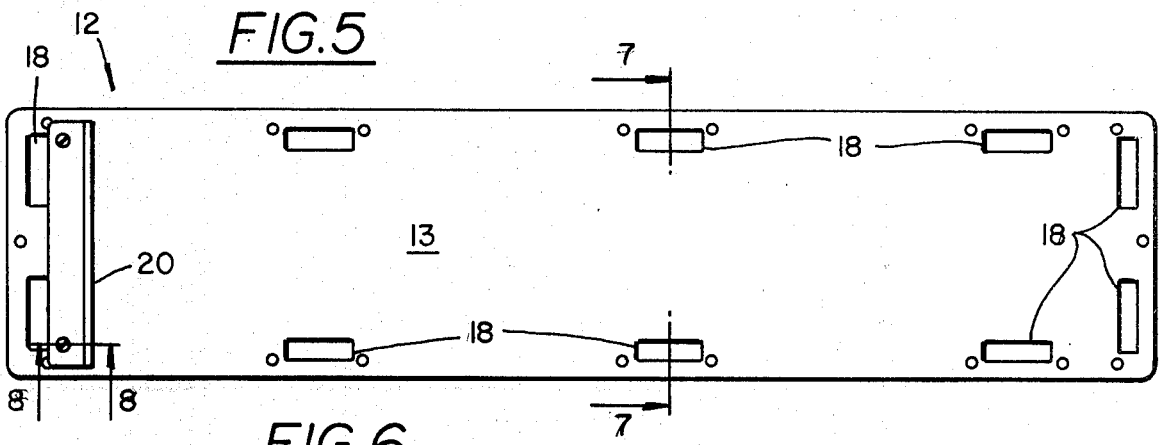
FIG. 5 is a top plan view of the stretcher.
Figure 6:
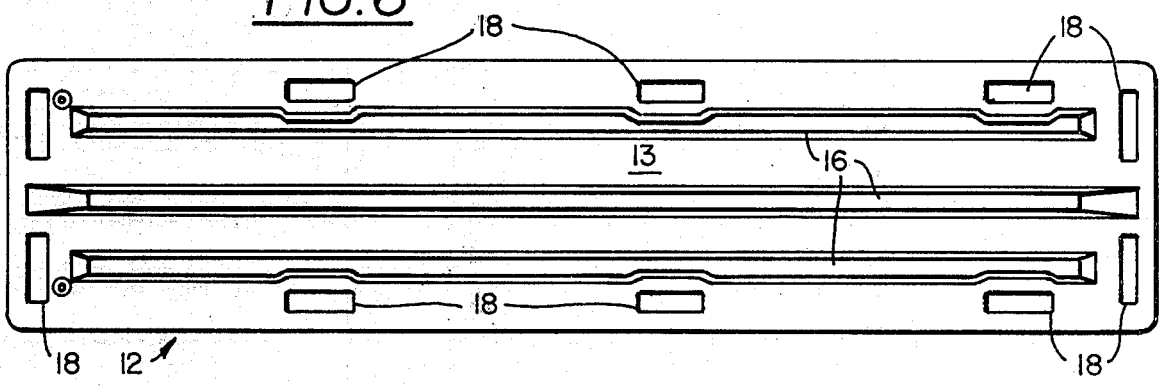
FIG. 6 is a bottom plan view of the stretcher.
Figure 7:
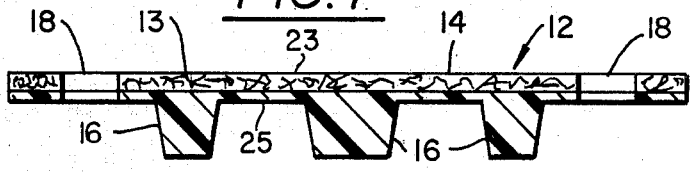
FIG. 7 is a sectional view taken on the line 7—7 in FIG. 5.
Figure 9:
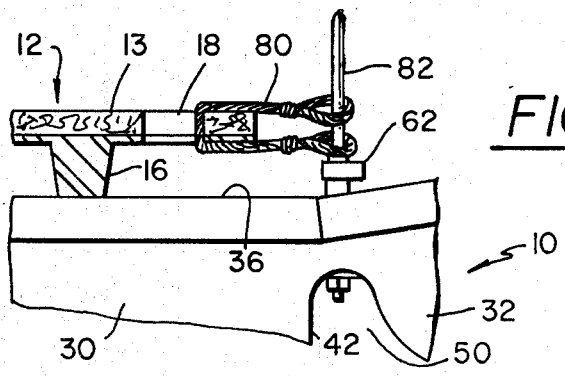
FIG. 9 is an enlarged detail view of the structure shown within the circle 9 in FIG. 4.
Figure 8:
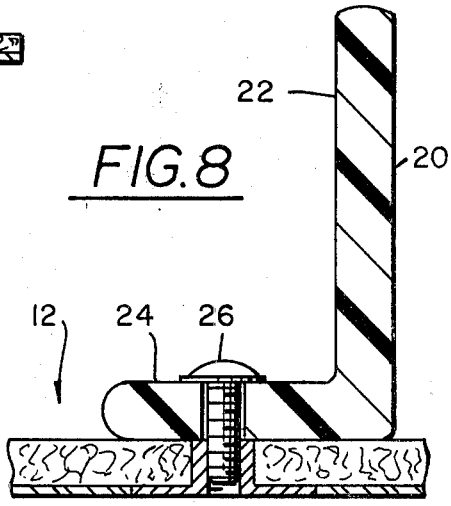
FIG. 8 is a fragmentary sectional view taken on the line 8—8 in FIG. 5.

Referring to FIG. 4, it will be noted that the pontoons 32 are spaced laterally outwardly from the body section 30 to provide elongated slots or grooves 50 in the underside which extend substantially the full length of the litter and are open at both ends. These slots or grooves provide channels for the flow of water when the raft or litter is pulled in a lengthwise direction, to reduce or eliminate fishtailing.

Elongated rails 60 extend lengthwise along both sides of the body section 30 above the top surface thereof, being suitably anchored in the body section by anchor brackets 62.

Elongated rails 70 extend lengthwise along the top surfaces of the pontoons, being anchored in the pontoons by anchor brackets 72. These rails 70 are parallel to and spaced from the rails 60 in an outboard direction.

FIGS. 1–4 and 9 show the stretcher disposed on the top surface or deck or the body portion 30 of the litter lengthwise thereof, being secured to the litter by straps 80 connected to hooks 82 mounted on the anchor brackets 62 at the ends of each rail 60. The straps 80 extend through adjacent hand holes in the stretcher. Straps 81, the ends of which are releasably secured to hooks 82, are for the purpose of being extended over the body of a person on the stretcher to tie him down securely. Other straps 85, the ends of which are releasably secured to certain hand holes in the stretcher, may be provided for the same purposes.

FIGS. 10 and 11 show a modification of the invention which differs from that shown in FIGS. 1–9 in that transverse straps 87 are provided for securing the stretcher to the litter. As shown, each strap 87 extends through hand holes on opposite sides of the stretcher and has one end looped over an adjacent rail 60. The straps 87 may be formed of any suitable material with or without an adjusting buckle to change its length. As shown in FIG. 10, one of the straps is looped over one rail 60 and the other two straps are looped over the other rail 60. By looping one or more straps over one rail and one or more over the other rail, the stretcher may be tied securely to the litter. Preferably, each strap has a simple, common adjusting buckle 89 in the form of a ring at one end. As seen in FIG. 11, the strap extends from the buckle down through a hand hole in the stretcher, then across the top of the stretcher and down through the opposite hand hole, then around a rail 60, back across the top of the stretcher and finally through the buckle or ring 89. When the strap is in tension, the buckle holds the strap from loosening by friction in the usual manner. Longer straps than those shown may, if desired, be used to tie a victim to the stretcher.

Figure 2:
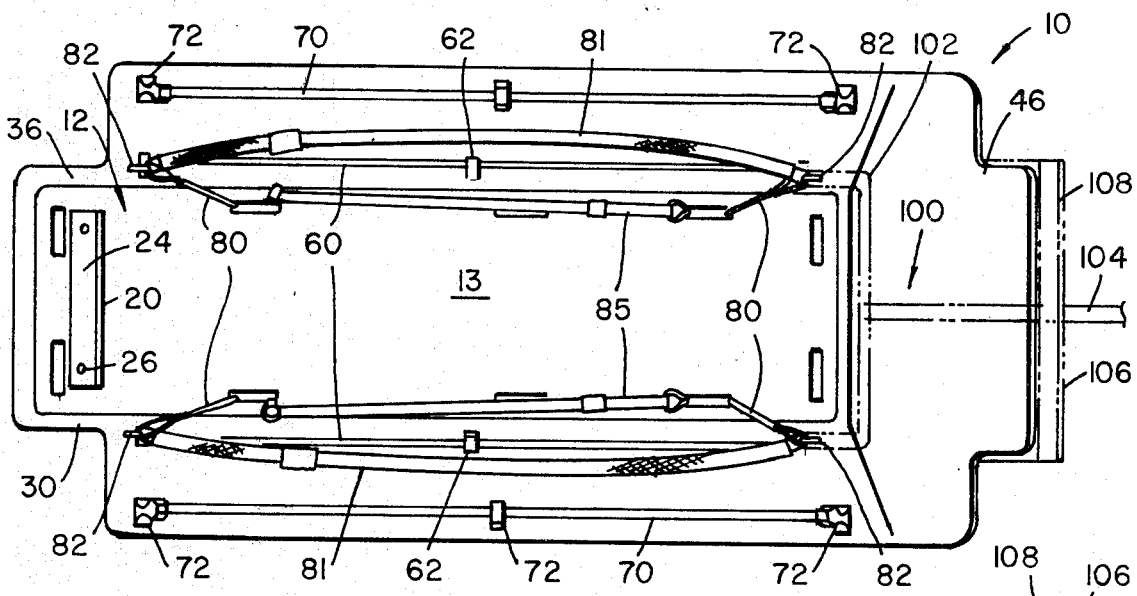
FIG. 2 is a top plan view of the litter and stretcher combination shown in FIG. 1.
Figure 3:
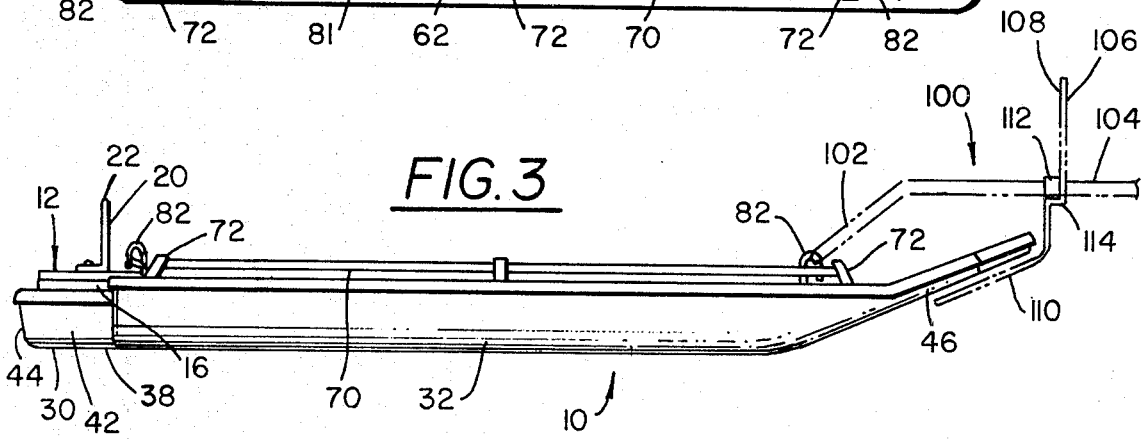
FIG. 3 is a side elevational view.

The raft or litter may be pulled through the water by a frame 100 shown in dotted lines in FIGS. 1–3. The frame 100 comprises a U-shaped frame member 102 the ends of which are pivoted to hooks 82 on the litter, and a tow bar 104. One end of the tow bar is secured to the midpoint of frame member 102 and the other end is adapted to be connected to a boat. A shield 106 mounted on the tow bar has a vertically upwardly projecting panel 108 and a downwardly projecting panel 110 curved under the front portion 46 of the litter. The shield, by acting somewhat as an extension of the front of the raft or litter, helps to prevent the front end from nosing under the water when towed. A cross member 112 is secured to the shield in a transverse offset portion 114 thereof. The cross member reinforces the shield, and also the connection to the tow bar 104 which extends through the cross bar and panel 108 of the shield.

As indicated above, the litter and stretcher combination is very useful in transporting a victim across water. By slightly submerging the raft portion of the unit, a "dry docking" effect is achieved and the victim floated into position and tied to the stretcher. A unit of this kind can be built weighing less than 50 pounds. It is easily managed and fits into a standard size ambulance. The victim may remain on the stretcher lashed to the litter until arrival at the treatment room, or in close quarters or when immediate reuse of the unit is necessary, the victim may be lifted from the litter via the stretcher. Another stretcher may then be secured to the deck of the litter and the unit sent back to the point of need. The ribs 16 support the board 13 of the stretcher above the deck of the litter, or above any other supporting surface so that the hands may be readily inserted in the hand holes 18 to lift the stretcher.

The litter and stretcher combination will support in excess 350 pounds and is virtually unsinkable. Because of its lightweight and unique design, the litter and stretcher combination performs equally as well in snow, surf or marshy areas as it does in streams and lakes.

I claim:

1. In combination, a rescue litter and stretcher, said stretcher having an elongated body section adapted to support a person in reclined position thereon, said litter being floatable and having an elongated body section adapted to receive and support said stretcher, and means for releasably securing said stretcher upon the body section of said litter, said securing means including rails on said litter along opposite sides of said stretcher, and a plurality of transverse straps a first of which releasably secures said stretcher to one of said rails and a second of which releasably secures said stretcher to the other of said rails, said stretcher having a plurality of hand holes in said body section spaced from one another along each side thereof with the holes along one side of said body section being respectively laterally opposed to the holes along the opposite side thereof to provide pairs of laterally opposed holes, said first strap extending through one pair of laterally opposed holes and looped over said one of said rails and said second strap extending through another pair of laterally opposed holes and looped over said other rail.

2. The combination defined in claim 1, wherein said stretcher has ribs on the underside of the body section thereof to support said stretcher on the body section of said litter with the body section of said stretcher elevated with respect to the body section of said litter so that said hand holes are readily accessible to lift said stretcher or to extend said straps therethrough.

3. The combination defined in claim 2, wherein said stretcher comprises an elongated board composed of upper and lower surface portions, one such portion including Acrylonitrile-Butadiene-Styrene material formed as a laminate of which the core is foamed and the opposite surfaces are substrate layers, and the other portion being formed of a relatively rigid plastic material.

4. The combination defined in claim 3, wherein said one portion has nylon skin laminates covering said substrate layers.

5. The combination defined in claim 4, wherein said relatively rigid plastic material is fiberglass reinforced.

6. The combination defined in claim 2, wherein said litter is formed of a relatively rigid plastic material having a tough shock and water resistant covering, said covering including Acrylonitrile-Butadiene-Styrene material formed as a laminate of which the core is foamed and the opposite surfaces are substrate layers.

7. The combination defined in claim 6, wherein nylon skin laminates cover said substrate layers.

* * * * *